United States Patent [19]

Brandenberger

[11] 4,359,198

[45] Nov. 16, 1982

[54] WARP CREEL FOR BEAM WRAPPING MACHINE

[75] Inventor: Albert Brandenberger, Oberuzwil, Switzerland

[73] Assignee: Maschinenfabrik Benninger AG, Uzwil, Switzerland

[21] Appl. No.: 244,334

[22] Filed: Mar. 16, 1981

[30] Foreign Application Priority Data

Aug. 4, 1980 [CH] Switzerland ..... 5890/80

[51] Int. Cl.[3] ..... B65H 49/02; D03J 5/08

[52] U.S. Cl. ..... 242/131.1

[58] Field of Search ..... 242/130–131.1, 242/129.72, 157 R; 57/58.36; 66/125 R, 127; 139/97, 98; 28/32, 34

[56] References Cited

U.S. PATENT DOCUMENTS

| | | | |
|---|---|---|---|
| 3,520,493 | 7/1970 | Carroll | 242/157 R |
| 3,753,274 | 8/1973 | Koslowski | 28/190 |
| 3,873,043 | 3/1975 | Wildi | 242/131.1 |
| 4,019,700 | 4/1977 | King | 242/131.1 |
| 4,234,138 | 9/1980 | Gehring et al. | 242/131.1 |

*Primary Examiner*—Leonard D. Christian
*Attorney, Agent, or Firm*—Werner W. Kleeman

[57] ABSTRACT

A warp creel for a beam warping machine is disclosed which comprises a number of bobbins arranged in horizontal and vertical rows, a thread or yarn or the like being continuously withdrawn from such bobbins. At the region of a predetermined portion or section of the warp creel, at the rear region of such creel, there extend a multiplicity of rods which rise vertically over all of the levels or storeys of the warp creel and impart a deflection or turning motion to the threads of at least one vertical bobbin row. The rods are displaceably supported between a preparatory position orienting the individual rods in front of the thread tensioning and monitoring devices of the related bobbin rows and a bunched together or clustered terminal position located towards the creel delivery or outfeed side and serving to separate the threads. Due to these measures it is possible to adequately separate the threads practically without any additional friction, and the accessibility for drawing-in the threads during bobbin change operations or thread rupture is completely maintained.

18 Claims, 7 Drawing Figures

WARP CREEL FOR BEAM WRAPPING MACHINE

BACKGROUND OF THE INVENTION

The present invention relates to a new and improved construction of a warp or bobbin creel for beam warping machines.

Generally speaking, the warp creel for beam warping machines of the present development is of the type wherein at least a part of the threads or the like which are outfed over a respective thread monitoring device from supply bobbins arranged to both sides of the creel in the lengthwise direction thereof and dispositioned at a number of levels or storeys are infed via thread guide means to the outfeed or delivery side of the warp or bobbin creel.

Such bobbin creels are used in the weaving industry in order to orderly infeed a warp sheet of threads wound upon bobbins, for instance to the winding device of a beam warping machine. The warp creels are constructed for this purpose in the form of lengthwise extending or elongated, advantageously V-shaped frames, to both sides of which there are donned the bobbins or the like in long rows and in a number of levels or storeys and from which the threads are continuously withdrawn in the direction of the creel delivery side, which is constituted by an end portion of the creel.

In order to orderly guide the threads over their entire free path of travel, which can be quite long particularly for the threads of the bobbins arranged furthest from the creel outfeed or delivery end, it has been proposed, according to French Pat. No. 1,108,771, to guide these threads through a plurality of tandemly arranged thread combs, or, as disclosed in German Pat. No. 2,544,528, through apertured diaphragms, Yet with such arrangements, particularly the threads which experience a multiple supporting action, are subjected to additional friction, so that the withdrawal or pay-off conditions within the bobbin creel tend to markedly vary. This can result in frequent thread breakage or rupture. Additionally, disadvantageous with this design is the great amount of time which is needed for newly drawing-in the threads or the like with such arrangements.

SUMMARY OF THE INVENTION

Therefore, with the foregoing in mind it is a primary object of the present invention to provide a new and improved construction of a warp creel for a beam warping machine which is not associated with the aforementioned drawbacks and limitations of the prior art proposals.

Another and more specific object of the present invention aims at providing a new and improved construction of a warp creel of the previously mentioned type which enables adequately separating the threads, while maintaining essentially the same withdrawal conditions for all of the threads of the creel, without impairing the accessibility of the bobbin or warp creel for a bobbin change or for rectifying a possible thread rupture which has arisen.

Yet a further significant object of the present invention aims at providing a new and improved construction of a warp creel for a beam warping machine, which is relatively simple in construction and design, extremely economical to manufacture, not readily subject to breakdown or malfunction, highly reliable in operation, requires a minimum of maintenance and servicing, and can be retrofitted on existing beam warping machines.

Now in order to implement these and still further objects of the invention, which will become more readily apparent as the description proceeds, the warp creel for a beam warping machine as contemplated by the present development is manifested by the features that the thread guide means at each side of the creel encompass a multiplicity of rods or bar members or the like which extend vertically over all of the levels or storeys of the creel and deflect the threads of at least one vertical bobbin row. These rods are moveably supported between a preparatory position, where the individual rods are arranged in front of the thread monitoring devices of the related bobbin rows, and a functional or operative position where the rods are clustered or bunched together at the delivery side of the creel and protrude from the related creel side while operating the threads.

Due to these measures it is now possible to sufficiently separate the threads, even of the bobbins furthest removed from the creel outfeed side, practically without any additional application of friction, in that the threads wrap or train about the clustered or bunched rods over only a fraction of the rods circumference, and the mutual spacing of the bunched together rods constitutes a measure for the spacing of the threads. On the other hand, in the preparatory position, where the rods are far apart from one another, it is possible to undertake rectification or elimination of a thread rupture or the exchange of a bobbin totally without being hindered.

To enable an easy displacement of the rods or the like from one end position into the other the equipment is advantageously constructed such that the rods, at each side of the creel, are guided at their end at an upper rail and a lower rail, respectively. It is advantageous if the rods bear by means of rollers at the rails or rail members.

To allow a conjoint displacement of the rods at each side of the creel, it is advantageous if neighboring rods at each creel side, preferably at both of their ends, are interconnected with one another by, in each case, a pair of toggle levers. For clustering or bunching the rods it is possible according to a further design of the warp or bobbin creel to have the rails at the end of the creel frame, opposite to the creel delivery or outfeed side, supported to be horizontally pivotable about pivot pins or the like. At the creel outfeed side rail end the rails are moved from a position at least approximately parallel to the related side of the creel, constituting the preparatory position, into a deflected-out or angled position constituting the operative or functional position, and there then already occurs a separation of the threads. Advantageously, the pivoted-out end of the rails, in the angled position, is in alignment with the one end of a stationary rail curved section for the clustered pushing together of the rods. The construction is advantageously undertaken such that the rail curved section or elements are curved from the end intended to coact with the rails in the direction of the creel outfeed or delivery end towards the creel. Moreover, the end of the rail curved sections, closer to the creel, in each case can be operatively connected by a pair of toggle lever or link elements with the last rod at the creel delivery end corresponding to side of the creel.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
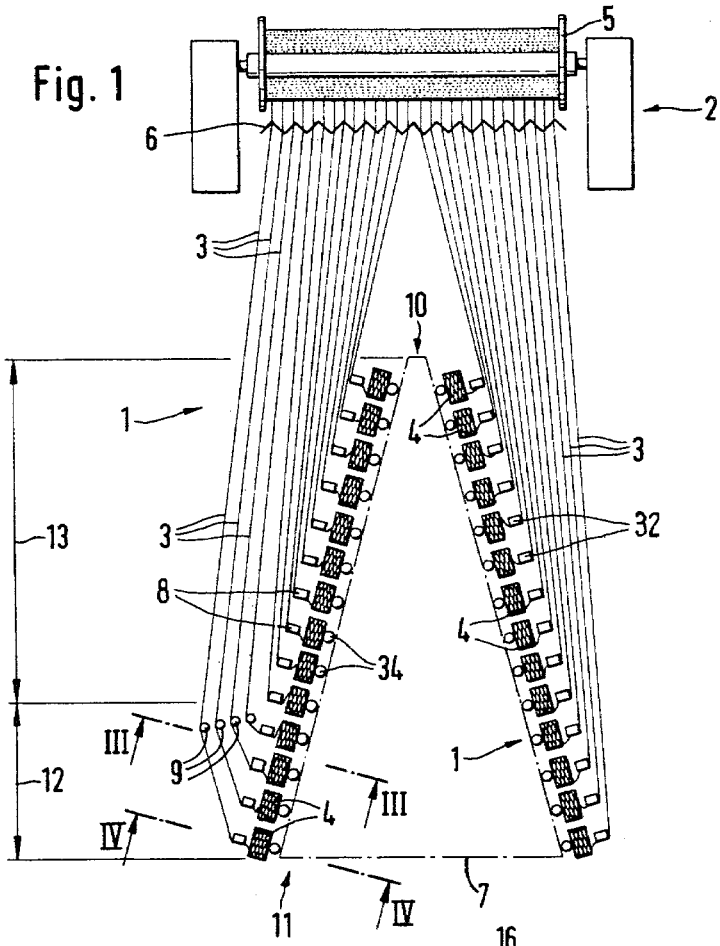
FIG. 1 is a top plan view in schematic illustration of a beam warping installation or machine containing a bobbin or warp creel and a winding device, the right-hand half of the illustration representing a conventional warp creel and the left-hand half of the illustration depicting a warp or bobbin creel constructed according to the invention.

Describing now the drawings, in FIG. 1 there is shown a simplified top plan view of a warping installation containing a warp or bobbin creel 1 and a beam warping machine 2. As is well known in this technology it is possible with such machines to withdraw the threads or yarns 3 of the bobbins 4 which are donned in the warp or bobbin creel 1 and to wind such withdrawn threads upon a warp or back beam 5. The guiding and distribution or pitch of the threads 3 is accomplished by means of a conventional warp comb 6.

The warp or bobbin creel 1 encompasses, in known manner, a lengthwise extending, substantially V-shaped frame or frame means 7. Upon such frame 7 there are donned the bobbins 4 at both sides thereof in long horizontal rows and in a number of levels or storeys above one another, as such will be described more fully hereinafter. In the thread withdrawal direction, extending towards the warp or back beam 5, the thread 3 of each bobbin 4 travels through a suitable thread tensioning and monitoring device 8 which, in their totality, in likewise known manner, are arranged at the brake panel of the creel 1 for all of the bobbins 4. The end of the creel 1 confronting the beam warping machine 2 forms the creel delivery or outfeed side 10, from which both of the lengthwise sides of the warp or bobbin creel 1 slightly extend outwardly towards the other end 11 of the creel 1.

In FIG. 1 the warp creel 1 has been illustrated at the right-hand portion of the showing as a conventional creel and at the left side thereof as a creel constructed according to the teachings of the invention.

At the right side of the showing of FIG. 1 the threads 3 extend from the bobbins 4 over their thread tensioning and monitoring devices 8 directly to the warp or back beam 6 of the beam warping machine 2. It will also be readily recognisable that the length of the warp creel 1 is limited, since the threads 3 withdrawn from the bobbins 4 of the end 11 of the creel 1 located furthest from the beam warping machine 2, owing to their appreciable free withdrawal path and the thus formed through-hang and their inherent oscillation, no longer can be positively guided and in a contact-free manner. Critical distances can be considered to be those exceeding five meters from the warp comb 6.

It is at this point that the present invention has particular applicability in that, as shown in FIG. 1 for the left-hand side of the illustrated warp or bobbin creel 1, at the region of the bobbin creel 1 to be described more fully hereinafter and located furthest from the creel delivery or outfeed side 10, the clustered rods 9 which extend away from the creel 1 in their operative or functional position and are partially trained by the threads 3, separate at this region the threads 3 from one another. These rods 9 or equivalent structure thus separate the threads 3 of the bobbins 4 of a creel section or region 12 located furthest from the creel outfeed side or end 10, whereas this is not necessary for the threads of the creel section or region 13 located closer to the creel outfeed end 10 because of their shorter distance from the warp comb 6. In this regard it is possible, or course, for the aforementioned creel sections or regions 12 and 13 to vary quite appreciably from one another, depending upon the structural length of the warp creel 1, the employed bobbin material and the field of application.

In any event the rods or rod members 9 cause opening of the thread sheet of the creel section 12 at the rear end region 11 of the warp or bobbin creel 1, without noticeably impairing the withdrawal conditions at the bobbins 4 in this creel region or section 12 in comparison to those prevailing at the creel section 13 closer to the creel delivery end 10. This enables constructing considerably longer warp creels than was heretofore possible.

The arrangement of the rods or rod members 9 at the bobbin or warp creel 1 has been shown in greater detail in FIGS. 2, 3 and 4 and will be described more fully hereinafter.

Figure 5C:
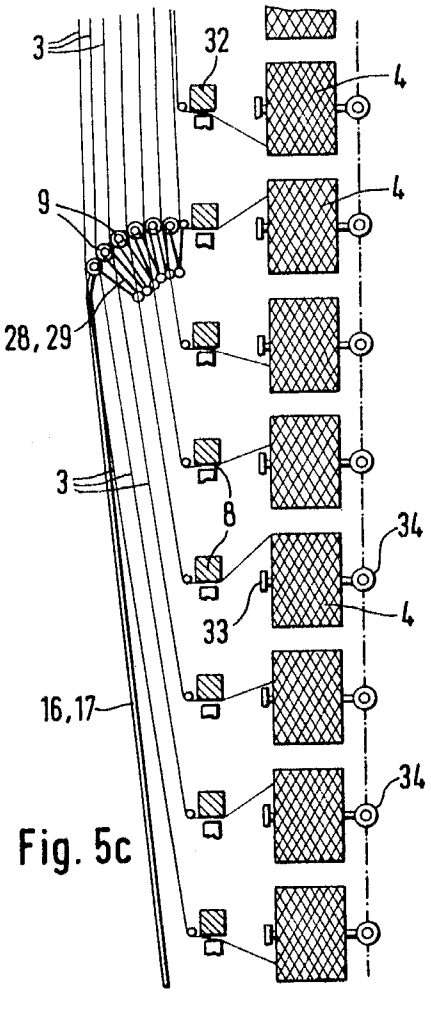
FIGS. 5*a*, 5*b* and 5*c* respectively illustrate different functional positions of the inventive thread guide means at corresponding warp creel sections, both in top plan view and on an enlarged scale.
Figure 5B:
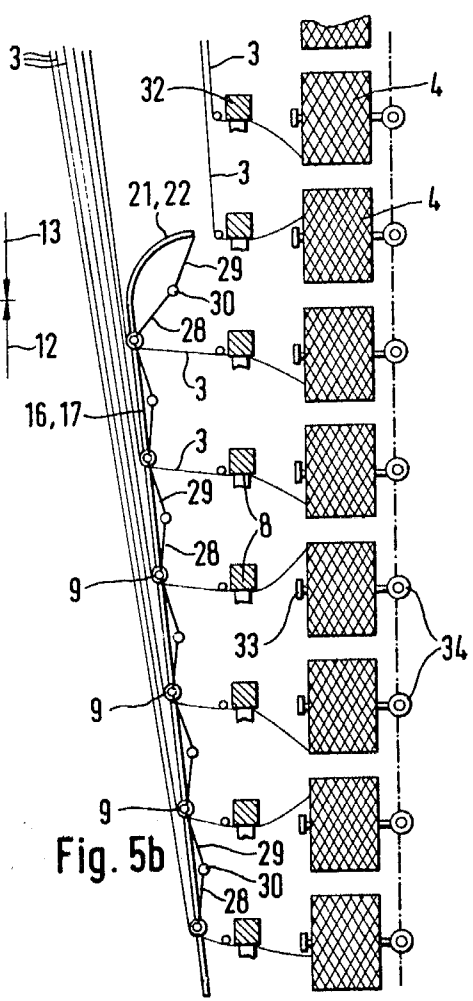
Figure 5A:
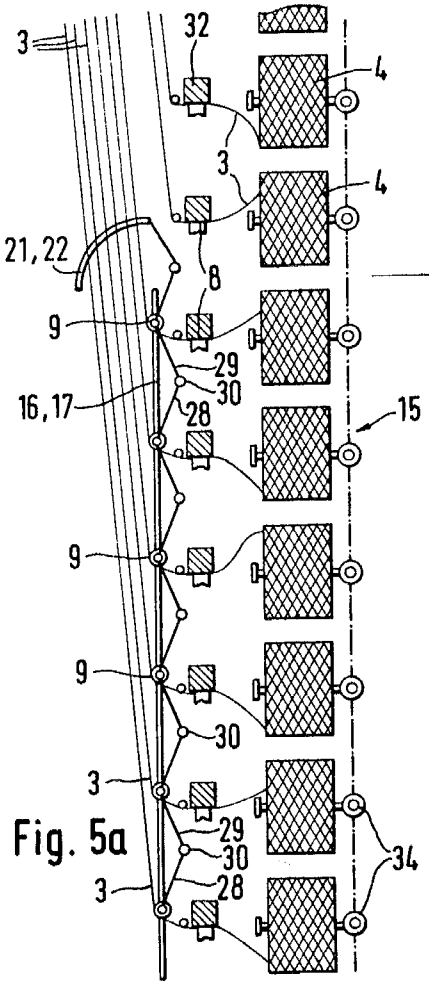

At the outset, however, there will be referred to FIGS. 5*a*, 5*b* and 5*c* from which there will be clearly seen that the rod members 9 are displaceable between a preparatory position (FIG. 5*a*) arranging the individual rods or rod members 9 before the thread tensioning and monitoring devices 8 of the bobbins 4 of a related vertical bobbin row 15, and a clustered or bunched operative position (FIG. 5*c*) separating the threads 3 and extending away from the creel 1.

Figure 2:
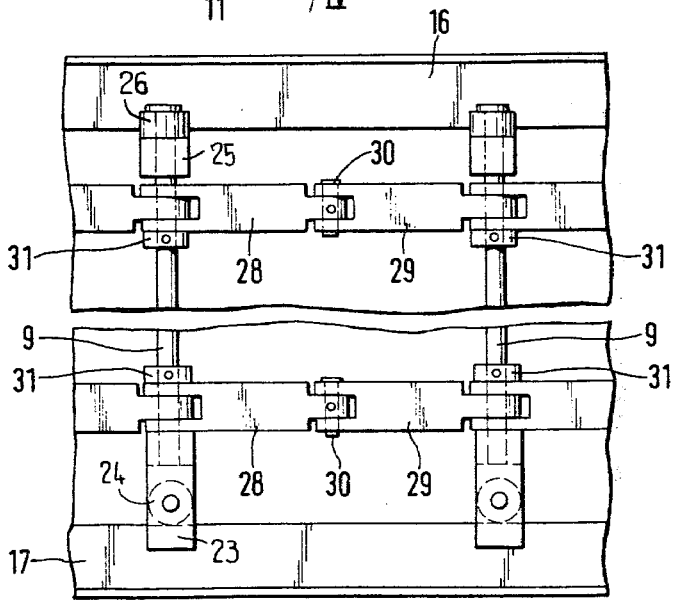
FIG. 2 is a fragmentary and side view of thread guide means arranged at the warp creel according to FIG. 1.
Figure 3:
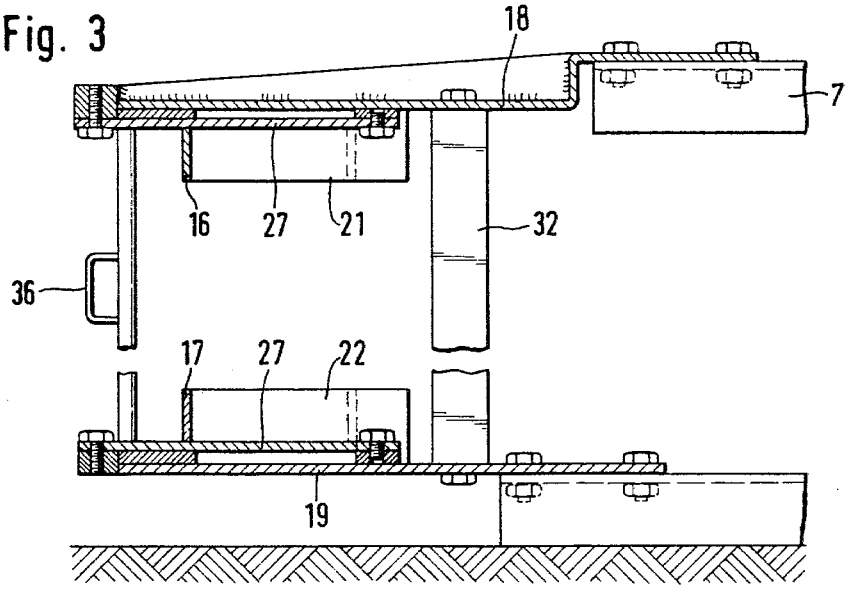
FIG. 3 is a sectional view of the arrangement of FIG. 1, on an enlarged scale, taken substantially along the line III—III thereof.
Figure 4:
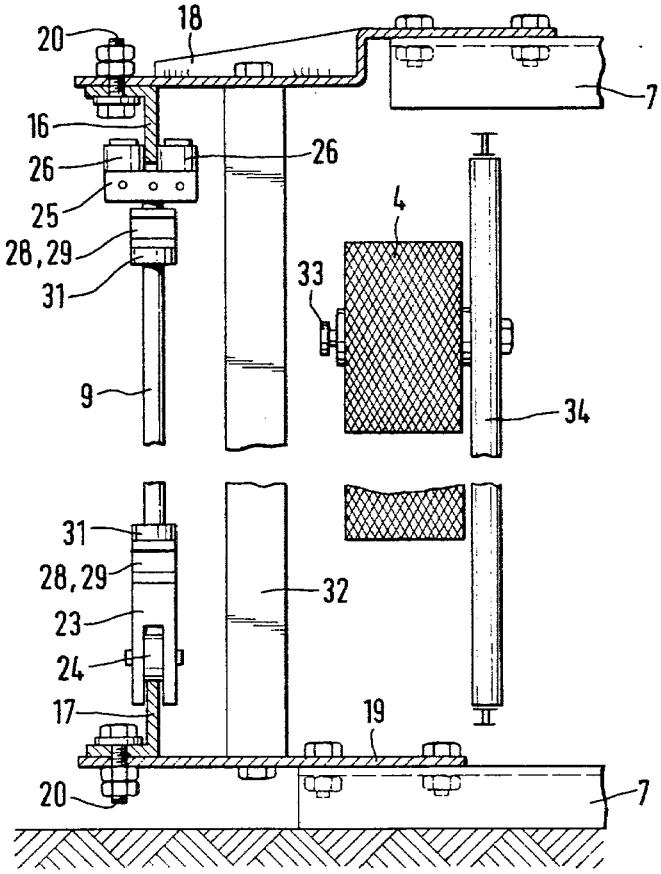
FIG. 4 is a sectional view, again on an enlarged scale, taken substantially along the line IV—IV of FIG. 1.

To this end the rods 9, as particularly well seen by referring to FIGS. 2 and 4, bear at an upper rail or rail member 16 and at a lower rail or rail member 17. The rails or rail members 16 and 17 are supported at upper longitudinal supports 18 and lower longitudinal supports 19, respectively, of the creel frame 7. The lower longitudinal support or carrier 19, connected with the creel frame 7, simultaneously serves as the floor or base portion of the creel 1. The arrangement of the rails 16 and 17 at both sides of the bobbin or warp creel 1 (in FIGS. 3, 4 and 5*a*, 5*b* and 5*c* there has only been illustrated in each case the left-hand side of a creel), is accomplished in such a manner that such are horizontally pivotably supported at the end 11 of the creel frame opposite the creel outfeed or delivery side about a respective pivot pin 20 and can be pivoted at the creel-outfeed side rail end from a position at least approximately parallel to the creel side (FIG. 5*a*) into a deflected or angled position (FIG. 5*c*).

The pivoted-out end of the rails 16 and 17, in the pivoted-out or deflected position (FIG. 5*c*) coacts with the one end of a stationary rail curved section or element 21 and 22, respectively, in such a manner that the rods 9 can be displaced from the rails 16 and 17 onto the rail curved sections or elements 21 and 22. The free end of the rails 16 and 17 is thus guided in an impact or stop frame 27 which delimits the pivotal movement.

As particularly well seen by referring to FIGS. 5*a*, 5*b* and 5*c*, the upper rail curved section or element 21 and the lower rail curved section or element 22 extend from the end thereof intended to coact with the rails 16 and 17 to the creel outlet or delivery side 10 and towards the creel and the frame 7.

To displace the rods 9 at and along the rails 16, 17 and the rail curved sections or elements 21 and 22, the rods 9 carry at their lower end a bifurcated or forked member 23 provided with a roller 24 which travels upon the lower rail 17 and the lower rail curved section or element 22. On the other hand, at its upper end each rod 9 carries a head member 25 having a roll pair 26 which is guided at the upper rail 16 and the upper rail curved section or element 21.

The individual rods 9 are mutually interconnected with one another, as is also the last creel-outlet side rod 9, with the creel proximate end of the related rail curved element 21 and 22, in each case by means of a pair of toggle levers 28, 29. Also the individual toggle lever elements 28, 29 are connected in pairs by a pivot bolt 30 at one end and at the other end are pivotably guided at the related rod member or rod 9 and held in position by adjustment rings 31. The length of the individual toggle lever elements 28 and 29 is chosen such that the rods 9, when the toggle lever elements of the pair of toggle levers 28, 29 are extended, possess one or a multiplicity of divisions or pitches corresponding to the pitch of the vertical bobbin rows of the creel 1.

There is advantageously provided an operating member 36, here shown as a handle, by means of which the rails 16 and 17 can be manually pivoted between their two end positions.

Basically, it is however possible to manually and/or with the aid of a machine, such as a drive motor, pivot or displace both the rails 16 and 17 and also the rods 9. Hence, conceptually the element 36 can be considered to constitute either an operating handle or a suitable displacement drive or the like.

Reverting now to FIG. 5*a* there will be initially seen that with the arrangement of the rods 9 in the there illustrated preparatory position in front of the vertical bobbin rows 15, the drawing or threading-in of the threads and the other manipulations needed for operating the equipment can be accomplished at this location equally without any hinderance as at the creel section 13 of the warp creel 1 free of rods 9. In this arrangement the rods 9 extend parallel to the columns 32 of the brake panel of the creel frame 7 which supports the thread tensioning and monitoring devices 8 and parallel to the columns 34 of the bobbin panel of the creel frame 7 and in a plane containing such columns 32 and 34, respectively. The columns 34 carry the bobbins 4 and the donning spindles 33 of a vertical bobbin row.

In order to be able to bring the rods 9 out of the preparatory position, illustrated in FIG. 5*a*, into their operative or functional position for the separation of the threads travelling over such rods, the rails 16 and 17 are initially outwardly pivoted about the pivot pins 20 into the intermediate position shown in FIG. 5*b*. Already in this case the threads 4, at the creel section or region 12 of the creel 1, have imparted thereto a different position than the position of the remaining threads.

Thereafter the rods 9 are displaced together into a cluster or bunch which extends away from the related creel side, and specifically, from the rear creel end 11. Consequently, the toggle lever elements of each pair of toggle levers 28, 29 tend to perform a scissor-like or toggle movement towards the creel 1, so that the rods 9 approach one another until such assume the position shown in FIG. 5*c* upon the rail curved elements 21 and 22. Consequently, the thread field at the aforementioned creel portion or section 12 is opened in desired manner such that the threads practically no longer can contact one another. Due to these measures it is therefore possible, with very little structural expenditure, and which readily enables retrofitting of existing warp creels, to provide a bobbin or warp creel which satisfies all of the requirements placed thereon.

It is of course possible to carry out a large spate of structural changes in the heretofore described exemplary embodiment of warp creel 1, without departing from the teachings and underlying principles of the present invention. Thus, by way of example, the attachment means and displacement means between the rods 9 and the rails 16, 17 can be differently constructed; further, the frame of the warp creel can possess parallel lengthwise sides and the bobbins of neighboring vertical rows can be offset or staggered, whereby then also each rod 9 can be operatively associated with for instance a number of vertical bobbin rows. In order to further facilitate the work at the creel, it additionally can be advantageous to mark the rods 9 and/or the columns or the like supporting the vertical bobbin rows, for instance by using a suitable colour arrangement or colour code, so that also in the clustered or bunched together operative position of the rods it is easily possible to detect which vertical bobbin row is operatively associated with which rod.

While there are shown and described present preferred embodiments of the invention, it is to be distinctly understood that the invention is not limited thereto, but may be otherwise variously embodied and practiced within the scope of the following claims. Accordingly,

What I claim is:

1. In a warp creel for a beam warping machine, wherein at least a part of the threads payed-off of supply bobbins arranged in the lengthwise extent of the creel to both sides thereof and in a number of levels are each infed by means of a respective thread monitoring device by thread guide means to an outlet side of the creel, the improvement which comprises:

said thread guide means at each creel side comprising a plurality of rods;

said rods extending substantially vertically over all levels of the creel and imparting a deflection to the threads of at least one vertical bobbin row; and means for displaceably supporting the individual rods so as to be moveable between a preparatory position, in which the individual rods are arranged forwardly of said thread monitoring devices of the related bobbin row, and an operative position in which the rods, at the creel outlet side, are clustered together to depend away from the related creel side and separating the threads.

2. The warp creel as defined in claim 1, wherein:

said supporting means comprise an upper rail and a lower rail for guiding the rods at each creel side at their ends.

3. The warp creel as defined in claim 2, further including:

roller means for supporting the rods at the rails.

4. The warp creel as defined in claim 1, further including:

a respective pair of toggle levers for interconnecting neighboring rods at each side of the creel.

5. The warp creel as defined in claim 4, wherein:

each toggle lever of a respective pair of toggle levers interconnects neighboring rods at both rod ends.

6. The warp creel as defined in claim 2, further including:

pivot means for horizontally pivotably supporting said rails at the end of a creel frame opposite the creel-outlet side and at the creel-outlet side rail end from a position at least approximately parallel to the related side of the creel, defining said preparatory position, into a deflected-out position defining said operative position.

7. The warp creel as defined in claim 6, further including:

stationary rail curved elements; and said pivoted-out end of the rails in their deflected-out position being aligned with one end of one of the stationary rail curved elements for the clustered displacing together of the rods.

8. The warp creel as defined in claim 6, further including:

impact means for limiting the pivotal movement of the rails.

9. The warp creel as defined in claim 7, wherein:

said rail curved elements are curved from an end thereof intended to coact with the rails in the direction of the creel outlet side towards the creel.

10. The warp creel as defined in claim 7, further including:

a respective pair of toggle lever means for connecting an end of the rail curved element closest to the creel with the last rod of the outlet side of the creel at the related creel side.

11. The warp creel as defined in claim 1, further including:

means for displacing the rods at each creel side between the preparatory position and the operative position.

12. The warp creel as defined in claim 11, wherein:

said displacing means comprise manually operative means.

13. The warp creel as defined in claim 11, wherein:

said displacing means comprise power drive means.

14. The warp creel as defined in claim 2, further including:

means for pivoting the rails at each side of the creel between said preparatory position and operative position and vice versa.

15. The warp creel as defined in claim 14, wherein:

said displacing means comprise manually operative means.

16. The warp creel as defined in claim 14, wherein:

said displacing means comprise power driven means.

17. The warp creel as defined in claim 1, wherein:

at least parts of the elements carrying a vertical bobbin row and the rods associated therewith when in their preparatory position are provided with means for indicating their operative correlation.

18. The warp creel as defined in claim 16, wherein:

said indicating means comprise colour marker means.

* * * * *